US005429281A

United States Patent [19]

Sellers

[11] Patent Number: 5,429,281

[45] Date of Patent: Jul. 4, 1995

[54] CONDIMENT SHAKER

[76] Inventor: Albert E. G. Sellers, 406 Upper Gulph Rd., Radnor, Pa. 19087

[21] Appl. No.: 330,675

[22] Filed: Oct. 28, 1994

Related U.S. Application Data

[63] Continuation of Ser. No. 979,328, Nov. 20, 1992, abandoned.

[51] Int. Cl.[6] ..... G01F 11/26

[52] U.S. Cl. ..... 222/457.5; 222/142.1

[58] Field of Search ..... 222/142.1–142.9, 222/457.5, 161, 196.1

[56] References Cited

U.S. PATENT DOCUMENTS

| | | | |
|---|---|---|---|
| 1,682,804 | 9/1928 | Searight | 222/457.5 |
| 2,252,835 | 8/1941 | Chenette | 222/457.5 |
| 2,366,963 | 1/1945 | Goldbert | 222/457.5 |
| 2,743,851 | 5/1956 | Sellers | 222/457.5 |
| 4,290,374 | 9/1981 | Maples | 222/457.5 |

FOREIGN PATENT DOCUMENTS

| | | | |
|---|---|---|---|
| 625361 | 2/1936 | Germany | 222/457.5 |
| 529861 | 11/1940 | United Kingdom | 222/457.5 |

*Primary Examiner*—Andres Kashnikow
*Assistant Examiner*—Lisa Douglas
*Attorney, Agent, or Firm*—Frederick J. Olsson

[57] ABSTRACT

Shaker for the condiments such as salt and pepper having a structure which provides for the salt or pepper to be discharged by shaking up and down but without reversing the shaker from its storage position, the condiment remaining is effectively isolated from the atmosphere.

6 Claims, 1 Drawing Sheet

Fig. 2
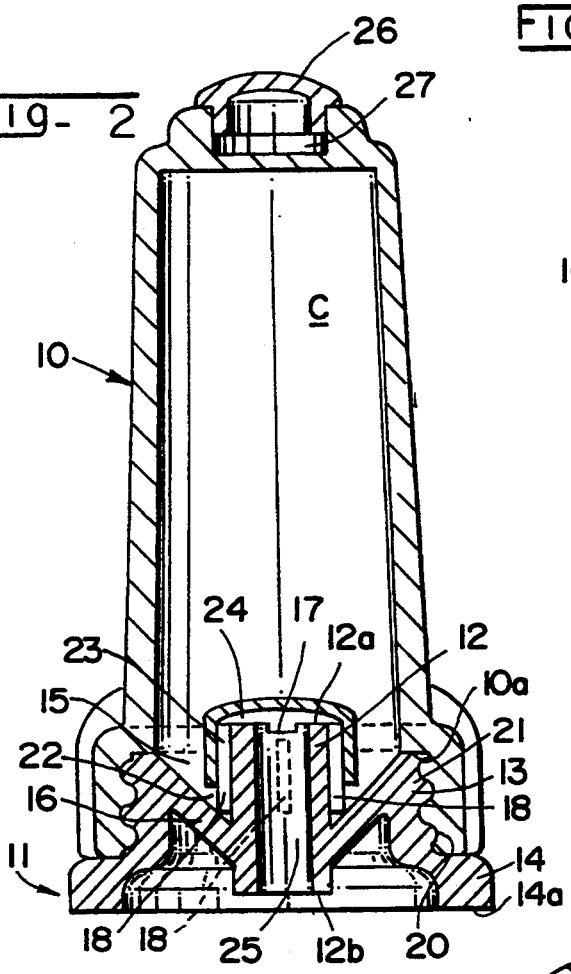
Fig. 1
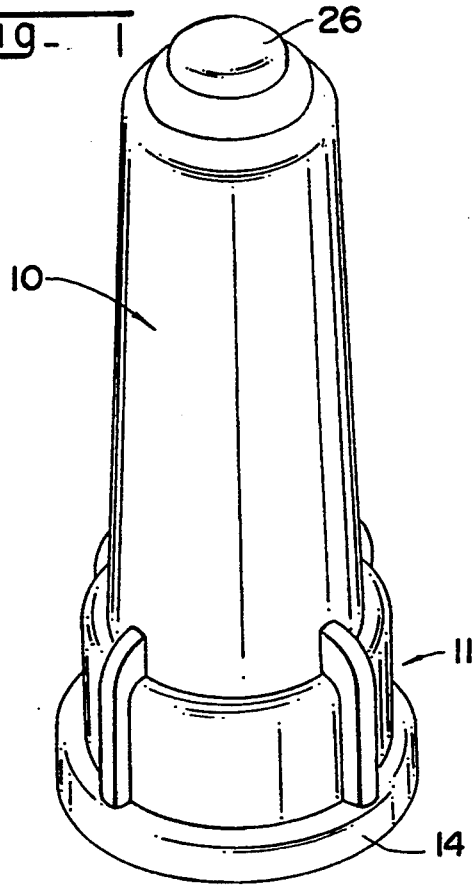
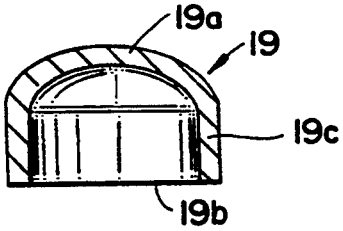
Fig. 3
Fig. 4
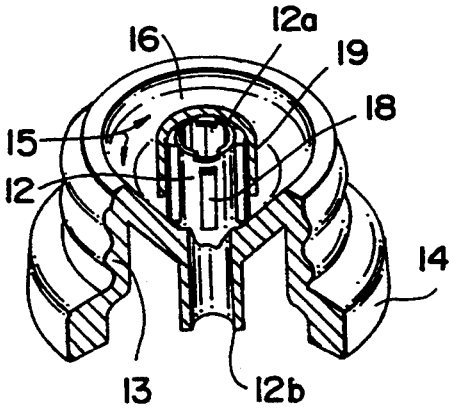
Fig. 5
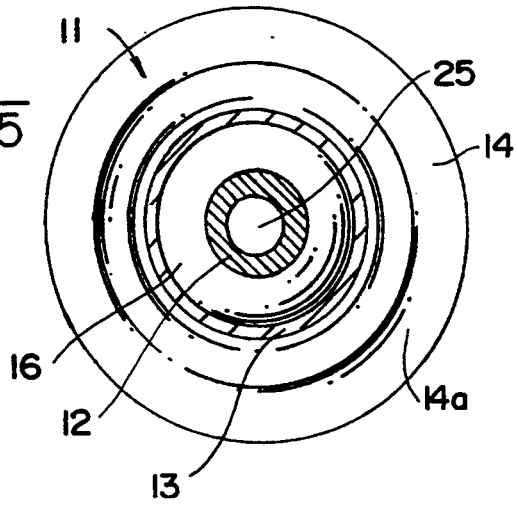

CONDIMENT SHAKER

This application is a continuation of application Ser. No. 979,328 filed Nov. 20, 1992, now abandoned.

This invention relates to dispensers for granulated substances, and more particularly to salt shakers adapted to minimize the effect of atmospheric moisture on the salt.

Prior to the present invention, many attempts to provide moisture-proof salt shakers employed structures designed to seal the contents in the salt shaker from the atmosphere. In an article such as a salt shaker it is practically impossible to provide an air-tight seal which will the seal the contents tightly when the shaker is not in use and yet be opened when it is desired to use the shaker. Other forms of moisture-resistant salt dispensers in which some form of a dead-air space is used to protect the salt from the moisture in the atmosphere have the disadvantage of having a narrow opening through which the salt must pass and wherein it may become clogged.

With the foregoing in mind the principal object of the present invention is to provide a novel salt dispenser wherein the salt is effectively isolated from contact with moisture in the atmosphere.

Another object of the present invention is to provide a novel salt dispenser in which there are no small openings which may become clogged by the salt.

Another object of the present invention is to provide a novel salt dispenser of the above-mentioned type wherein there are no projections or edges on which the salt may collect.

A still further object of the present invention is to provide a novel salt shaker having the advantages and characteristics set forth which may be manufactured easily and cheaply and which is entirely efficient and effective in operation and use.

These and other objects of the present invention and the various features and details of the operation and construction thereof are hereinafter more fully set forth and described with reference to the accompanying drawing, in which:

FIG. 1 is a view in perspective of a salt dispenser made in accordance with the present intention;

FIG. 2 is a sectional view diametrically through the dispenser shown in FIG. 1;

FIG. 3 is a perspective view partially in section of a cap used in the dispenser of FIG. 1;

FIG. 4 is a perspective view , partially in section, of the base used in the dispenser shown in FIG. 2

FIG. 5 is a bottom view partially in section of the dispenser shown in FIG. 2.

Referring to the drawings, the dispenser includes a hollow cover 10 and an annular, base 11 which supports the cover. The cover 10 and base provide a chamber C for condiment.

The base 11 is formed with an inner cylinder 12 which has an upper open end 12*a* and a lower open end 12*b*. The base is also formed with an outer cylinder 13 and annular flange 14. The inner and outer cylinders 12 and 13 are positioned to form the annular space, 15. An annular rib 16, is disposed between the ends 12*a* and 12*b* and extends across the space 15 and connects the inner and outer cylinders 12 and 13. The top of the inner cylinder 12 has lateral slots 17. Also, the outer surface of the inner cylinder has vertical ribs 18.

A concave or dome shaped cap 19 is disposed over the inner cylinder 12. The cap 19 has a closed end 19*a*, an opened end 19*b* and wall 19*c* therebetween extends down into the annular space 15 over the vertical ribs 18 toward the annular rib 16.

As noted in FIG. 2, the ribs 18 engage the inside surface of the wall 19*c*. This is a sliding fit for ease of assemble but, of course, tight enough so the cap will not come loose during shaking. Also, as noted in FIG. 2, the closed end 19*a* engages the tops of the ribs 18. Moreover, the lower edge of the wall forming the open end 19*b* is spaced above the annular rib 16.

The outer cylinder J3 is externally threaded at 20 to receive the internal threads 21 of the cover 10. The threads releasably hold the cover 10 and base together.

The annular flange 14 has a flat surface 14*a*, which, when the dispenser is placed on a flat table or the like, positions the dispenser in an upright manner. Note that the lower open end 12*b* of the inner cylinder 12 is spaced inwardly from the surface 14*a* so that it does not contact the table.

The engagement of the threads 20 and 21 provides that the dispenser may be grasped and shaken to discharge the salt therefrom without the various parts thereof becoming detached.

The part of the cover 10 above the internal screw threads 21 is provided with an undercut shoulder 10*a* which overlies the upper end edge of the outer cylinder 13 so that the inner surfaces of the cover 10 and annular rib 16 are flush. This arrangement presents a continuous smooth surface having no projections on which the salt may collect.

The foregoing structure is dimensioned to provide: An annular entry passageway 22 for conducting condiment between the annular rib 16 and the end 19*b* of the cap 19; a first intermediate passageway 23 for conducting condiment between the wall 19*c* of the cap 19 and the outside of the inner cylinder 12; a second intermediate passageway 24 for conducting condiment between the closed end 19*a* of the cap and the top of the inner cylinder 12; and an exit passageway 25 for conducting condiment through the inside of the inner cylinder 12.

The entry passageway 22 is in communication with the chamber C, the first intermediate passageway 23 is in communication with the entry passageway 22, the second intermediate passageway 24 is in communication with the first intermediate passageway 23, and the exit passageway 25 is in communication with the second intermediate passageway 24.

Thus, when the dispenser is moved up and down, the condiment will be moved from chamber C, through the entry passageway, through the first intermediate passageway, through the second intermediate passageway and then thru the exit passageway.

Also, it will be observed that condiment can move from the first intermediate passageway 23 thru the lateral slots 17 into the exit passageway 25.

The top of the inner cylinder 12 forming the open end 12*a* is beveled toward the inside of the cylinder between the slots 17, to provide minimum obstruction to passage of the material into the exit passageway 25.

A colored button 26 may be secured to the top of the cover 10 so that it is possible to distinguish between salt and pepper shakers. Preferably, the button 26 is secured in a recess or a cavity 27 which is sealed by the button 26 and serves to provide a dead-air chamber in the top of the cover in confronting relation to the container open end to minimize heat transfer to and from the inner surface of the cover top portion which overlies the open end of the container.

The salt dispenser is filled by orienting the dispenser with the base up, unscrewing the base, pouring the salt into the cover and screwing back the base.

I claim:

1. In a condiment dispenser:

an elongated, hollow cover having opposite ends and also having an axis;

a closure means forming one of said opposite ends of said cover;

a base forming the other of said opposite ends of said cover, said base, said cover, and said closure providing a chamber extending along said axis for holding said condiment;

said base being formed with an outer cylinder engaging said cover, the engagement providing for the cover and the base to be releasably held together;

said outer cylinder having a support surface for resting the dispenser on a flat surface to orient the ,dispenser in an upright position;

said base being formed with an inner cylinder having first and second oppositely disposed open ends, the inner and outer cylinders being positioned to form an annular space therebetween and said second open end of said inner cylinder being spaced inwardly from said support surface;

said base being formed with an annular rib disposed in a position between said firsthand second open ends of said inner cylinder and extending between said inner and outer cylinders;

a concave cap disposed over said inner cylinder and spaced from said cover, the concave cap having a closed end, an end forming an open mouth, and a wall therebetween;

said wall of the cap extending into said annular space toward said annular rib, said end which forms said open mouth of the cap being spaced from the annular rib to provide an annular entry passageway for conducting condiment and the annular entry passageway being in communication with the said chamber;

the inside surface of said wall of the cap being spaced from the outside surface of said inner cylinder to provide a first intermediate annular passageway for conducting condiment, the first intermediate passageway being in communication with said entry passageway;

said closed end of the cap being spaced from said first open end of said inner cylinder to provide a second intermediate annular passageway for conducting condiment, the second intermediate annular passageway being in communication with said first intermediate annular passageway;

said first and second open ends and the inside of said inner cylinder providing an exit passageway for conducting condiment, the exit passageway being in communication with said second intermediate annular passageway and the second open end of said inner cylinder being open to the atmosphere to conduct condiment thereto;

a plurality of narrow ribs each oriented in a direction along said axis and extending between and disposed in the space between the inside surface of the wall of said concave cap and the outside surface of said inner cylinder, the ribs being narrow so as not to impede conduction of condiment through said first intermediate annular passageway; and the foregoing structure providing that when condiment is in said chamber, the same may be removed by shaking the dispenser in a direction along said axis whereby condiment is moved: (a) thru said entry passageway; (b) through said first intermediate passageway; (d) through said exit passageway and through said second open end of said inner cylinder to the atmosphere.

2. For a condiment dispenser having a hollow cover, the subcombination comprising:

a base being formed with an outer cylinder having an axis and also having a surface for use in being engaged by said cover, the engagement providing for the cover and the base to be releasably held together;

said outer cylinder having a support surface for resting the dispenser on a flat surface to orient the dispenser in an upright position;

said base being formed with an inner cylinder having first and second oppositely disposed open ends, the inner and outer cylinders being positioned to form an annular space therebetween and said second open end of said inner cylinder being spaced inwardly from said support surface;

said inner cylinder being formed with said first open end beveled toward the inside of the inner cylinder;

said base being formed with an annular rib disposed in a position between said first and second open ends of said inner cylinder extending between said inner and outer cylinders;

a concave cap disposed over said inner cylinder, the concave cap having a closed end, an end forming an open mouth, and a wall therebetween;

said wall of the cap extending into said annular space toward said annular rib, said end which forms said open mouth of the cap being spaced from the annular rib to provide an annular entry passageway for use in conducting condiment;

the inside surface of said wall of the cap being spaced from the outside surface of said inner cylinder to provide a first intermediate annular passageway for use in conducting condiment, the first intermediate passageway being in communication with said entry passageway;

said closed end of the cap being spaced from said first open end of said inner cylinder to provide a second intermediate annular passageway for use in conducting condiment, the second intermediate annular passageway being in communication with said first intermediate annular passageway;

said first and second open ends and inside of said inner cylinder providing an exit passageway for use in conducting condiment, the exit passageway being in communication with said second intermediate annular passageway and the second open end of said inner cylinder being open to the atmosphere for conducting condiment thereto; and a plurality of narrow ribs each oriented in a direction along said axis and extending between and disposed in the space between the inside surface of the well of said concave cap and the outside surface of said inner cylinder, the ribs being narrow so as not to impede conduction of condiment through said first intermediate annular passageway.

3. For a condiment dispenser having a hollow cover, the subcombination comprising:

a base being formed with an:outer cylinder having an axis and also having a surface for use in being engaged by said cover, the engagement providing for the cover and the base to be releasably held together;

said outer cylinder having a support surface for resting the dispenser on a flat surface to orient the dispenser in an upright position;

said base being formed with an inner cylinder having first and second oppositely disposed open ends, the inner and outer cylinders being positioned to form an annular space therebetween and said second open end of said inner cylinder being spaced inwardly from said support surface;

said inner cylinder being formed with said first open end beveled;

said base being formed with an annular rib disposed in a position between said first and second open ends of said inner cylinder and extending between said inner and outer cylinders;

a concave cap disposed over said inner cylinder, the concave cap having a closed end, an end forming an open mouth, and a wall therebetween;

said wall of the cap extending into said annular space toward said annular rib, said end which forms said open mouth of the cap being spaced from the annular rib to provide an annular entry passageway for use in conducting condiment;

the inside surface of said wall of the cap being spaced from the outside surface of said inner cylinder to provide a first intermediate annular passageway for use in conducting condiment, the first intermediate passageway being in communication with said entry passageway;

said closed end of the cap being spaced from said first open end of said inner cylinder to provide a second intermediate annular passageway for use in conducting condiment, the second intermediate annular passageway being in communication with said first intermediate annular passageway;

said first and second open ends and the inside of said inner cylinder providing an exit passageway for use in conducting condiment, the exit passageway being in communication with said second intermediate annular passageway and the second open end of said inner cylinder being open to the atmosphere for conducting condiment thereto; and a plurality of narrow ribs each oriented in a direction along said axis and extending between and disposed in the space between the inside surface of the wall of said concave cap and the outside surface of said inner cylinder, the ribs being narrow so as not to impede conduction of condiment through said first intermediate annular passageway.

4. The condiment dispenser of claim 1 wherein said inner cylinder is formed with said first open end beveled toward the inside of the inner cylinder.

5. The condiment dispenser of claim 1 wherein said inner cylinder is formed with said first open end beveled.

6. The condiment dispenser of claim 3 wherein said bevel is in a direction toward the inside of said inner cylinder.

* * * * *